US005816399A

United States Patent [19]

Rhee

[11] Patent Number: 5,816,399

[45] Date of Patent: Oct. 6, 1998

[54] GOLF BAG WITH STAND

[76] Inventor: Yong Su Rhee, 138-26 Yun Hui 2nd Dong, Seo Dae Moon-Ku, Seoul, Rep. of Korea, 120-112

[21] Appl. No.: 689,390

[22] Filed: Aug. 12, 1996

[30] Foreign Application Priority Data

Aug. 11, 1995 [KR] Rep. of Korea ..... 20730

[51] Int. Cl.[6] ..... A63B 55/00; A63B 55/06

[52] U.S. Cl. ..... 206/315.7; 248/96

[58] Field of Search ..... 206/315.3, 315.7, 206/315.8; 248/96

[56] References Cited

U.S. PATENT DOCUMENTS

| | | | |
|---|---|---|---|
| 1,197,298 | 9/1916 | McGregor | 248/96 |
| 1,791,188 | 2/1931 | Bright | 248/96 |
| 1,840,663 | 1/1932 | Gallagher . | |
| 1,960,099 | 5/1934 | Donovan | 206/315.3 X |
| 2,305,517 | 12/1942 | Cox | 248/96 |
| 2,324,439 | 7/1943 | Thommen | 248/96 |
| 2,571,088 | 10/1951 | Walton | 248/96 |
| 3,758,061 | 9/1973 | Townhill | 248/96 |
| 3,787,017 | 1/1974 | Sauer | 248/96 |
| 4,506,854 | 3/1985 | Kim | 248/96 |
| 4,676,464 | 6/1987 | Reimers | 248/96 |
| 4,722,501 | 2/1988 | Ruhl | 248/218.4 |
| 4,759,963 | 7/1988 | Uso, Jr. et al. | 428/100 |
| 4,921,192 | 5/1990 | Jones | 248/96 |
| 4,949,844 | 8/1990 | Yang | 206/315.7 |
| 5,042,654 | 8/1991 | Jones | 206/315.3 |
| 5,147,089 | 9/1992 | Anderson | 248/96 |
| 5,152,483 | 10/1992 | Maeng | 248/96 |
| 5,154,377 | 10/1992 | Suk | 248/96 |
| 5,156,366 | 10/1992 | Anderson | 248/96 |
| 5,178,273 | 1/1993 | Igarashi | 248/96 X |
| 5,209,350 | 5/1993 | Maeng | 206/315.7 |
| 5,236,085 | 8/1993 | Quellais | 206/315.7 |
| 5,303,888 | 4/1994 | Seop | 248/96 |
| 5,314,150 | 5/1994 | Seop | 248/96 |
| 5,339,951 | 8/1994 | Chen | 206/315.7 |
| 5,340,063 | 8/1994 | Hsieh | 248/96 |
| 5,356,003 | 10/1994 | Gretz et al. | 206/315.7 |
| 5,390,788 | 2/1995 | Schenkkan | 206/315.7 |
| 5,407,155 | 4/1995 | Chung | 248/96 |
| 5,415,285 | 5/1995 | Reimers | 206/315.7 |
| 5,464,180 | 11/1995 | Cheng | 206/315.7 X |
| 5,507,384 | 4/1996 | Maeng | 206/315.7 |
| 5,516,064 | 5/1996 | Hsieh | 248/96 |
| 5,607,128 | 3/1997 | Suk | 206/315.7 X |

OTHER PUBLICATIONS

The Golf Store Catalogue from Golfsmith, Apr. 1994, No. 366, 368 and 369.

The Golf Store Catalogue from Golfsmith, Jun. 1994, p. 44, No. 366, 368, 369.

Best! Products Catalogue, 1993–1994, p. 438, No. 12.

Golf Day, Catalog, No. 116A, pp. 12 and 28, No. 400–020; 400–021; 147–071, 516–200 and 575–001.

*Primary Examiner*—Sue A. Weaver
*Attorney, Agent, or Firm*—Fisher, Christen & Sabol

[57] ABSTRACT

A golf bag assemblage which includes: (a) a golf bag and (b) a rigid base mounted on the bottom of the golf bag. An indentation is located in the bottom of the rigid base and opens to the side and bottom of the base. A stand is attached to the golf bag. The stand includes: (i) support arrangement having two legs, each of which has a top cross bar; and (ii) arrangement for pivotally affixing the top cross bars (i) to the top portion of the golf bag. The push rod arrangement (iii) has two vertical side rods, a bottom push arrangement, and a short, inwardly-facing cross bar on the top end of each of the push rods. The short cross bars (iii) are pivotally mounted to the legs below pivotal arrangement (ii). The bottom push arrangement is a flat, vertical element which extends into the large indentation of the rigid base. An elastic loop (iv) is attached between the top portion of the two support legs below the pivotal mountings of the two side rods. The tension of the elastic loop (iv) urges the two rods back into alignment with the golf bag. A push rod holder (v) is attached to the bottom portion of the golf bag and through which the bottom portion of the two side rods freely slide. The pressure on the bottom of the push rod arrangement causes the two legs to swing out to provide support for the golf bag when in a tilted position.

2 Claims, 4 Drawing Sheets

FIG. 4
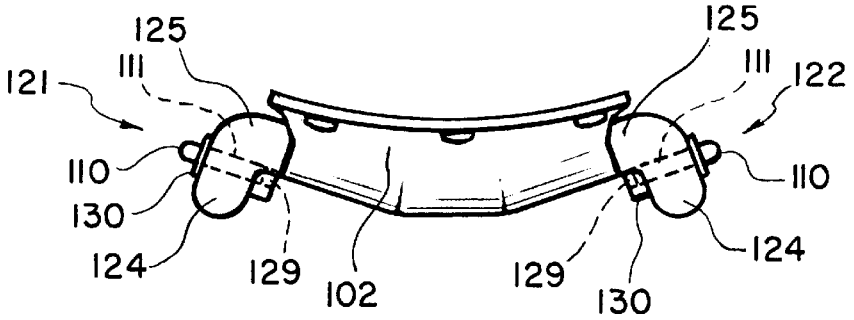
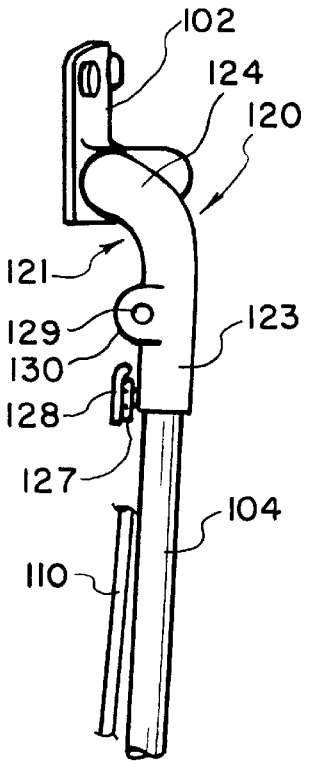
FIG. 5
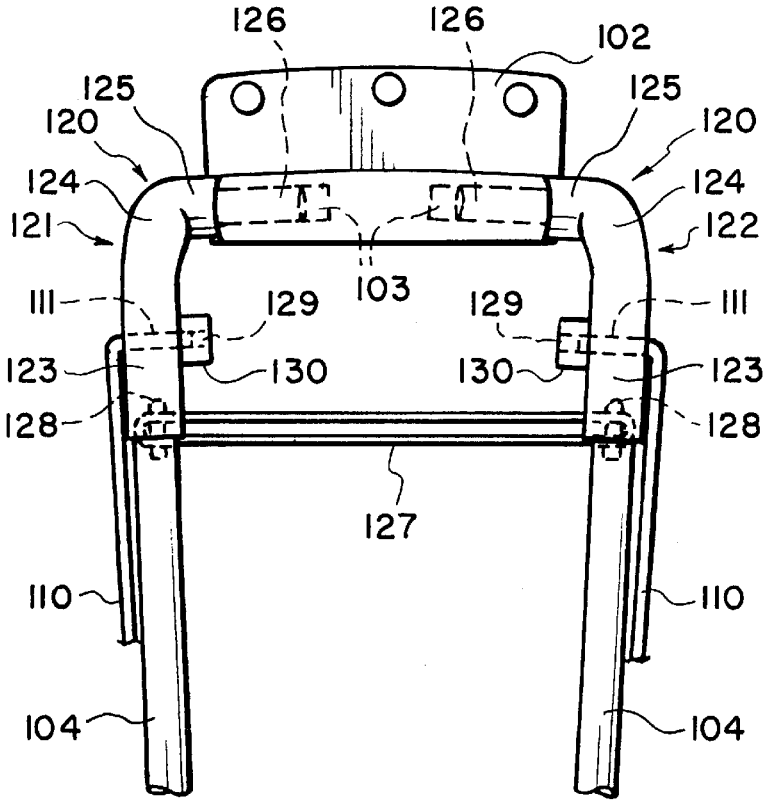
FIG. 6

GOLF BAG WITH STAND

BACKGROUND OF THE INVENTION

1. Field of the Invention

The invention relates to golf bag stands and, in particular, to those golf bag stands which are self-opening and self-closing when they are put down and picked up, respectively.

2. Background Art

There are numerous golf bag stands which open when the golf bags to which they are fixed or attached are placed down and which close when the bags are picked up.

A common type of such self-opening and self-closing golf bag stands in the prior art can be described as a tripod. That is, this type of stand typically has two rigid support members which are attached to or attachable to a golf bag and which are hinged so that they can be extended and retracted. The third leg of the tripod is the golf bag. Some of the prior art stands have a push rod mechanism. Specifically, when pressure is applied to the push rod of one of these prior art stands, the upper portion of the push rod expands. This expansion causes the legs of the stand to open.

U.S. Pat. No. 5,042,654 (Jones) discloses a golf bag which has a rigid cap at its lower extremity. The bottom rigid cap has a cavity formed in it to provide a hand hold to facilitate lifting of the lower end of the golf bag when it is desired to move the bag in a horizontal orientation. The golf bag has legs that are movable between an extended position where they support the bag upright and a retracted position where they are in adjacency with the bag. An actuation mechanism moves the legs to their extended position when the bag is urged downwardly when in a vertical orientation with the actuation mechanism in contact with the ground. The base can be partially relieved to permit downward movement of the bag when the actuation mechanism is in contact with the ground without the actuation mechanism being in contact with the ground when the bag is vertical and the nonrelieved portion of the base is resting on the ground. The ground end of the actuation mechanism does not lie under or extend under the bottom of the golf bag. A platform is positioned in the bag above the relieved portion of the base. The platform is planar and oriented substantially normal to the elongate axis of the bag and arranged to engage golf clubs placed in the bag above the relieved portion.

U.S. Pat. No. 1,197,298 (McGregor) discloses a golf bag having a folding stand mechanism. A toggle linkage at the lower portion of the folding stand mechanism has a foot with an inward facing vertical arm. At no time does the inward facing vertical arm extend under the bottom of the golf bag, but it does hold the bottom of the bag off of the ground when the folding stand mechanism is in the extended stage.

BROAD DESCRIPTION OF THE INVENTION

An object of the invention is to overcome the disadvantages and problems of the prior art stands. Another object of the invention is to provide a light-weight golf bag stand which can be applied to golf bags, even those with back apparel pockets. Another object of the invention is to provide a stand which has actuating means which prevent the over extension of the stand legs when the bag is in the tilted position. Another object of the invention is to provide a lightweight golf bag stand which does not significantly increase the effective volume of the golf bag and which, therefore, even when attached to a golf bag, is easy to transport. A further object of the invention is to provide a self-opening and self-closing stand the legs of which will not automatically extend when the bag to which it is attached is in an upright position. A still further object of the invention is to provide a sturdy stand which can bear heavy weight and which is not unsteady when placed on uneven ground. Other objects and advantages of the invention are set out herein or are obvious herefrom to one skilled in the art.

The invention involves a golf bag assemblage which is a golf bag having a top portion and a bottom portion. There is a rigid base or cap mounted on the bottom of the golf bag. An indentation is located in the bottom of the rigid base. The indentation opens to the side and bottom of the base. There is also a stand for the golf bag. The stand comprises:

(i) support means having two legs and a top cross bar, the top end of each of the two legs being a short, inwardly-facing cross bar, and both of the legs extending downward;

(ii) means for pivotally affixing each of the top cross bars (i) to the top portion of the golf bag;

(iii) push rod means having two vertical side rods, a bottom push arrangement to which the bottom of each of the two side rods is attached, and a short, inwardly-facing cross bar on the top end of each of the push rods, each of the short cross bars (iii) being pivotally mounted to one of the legs below pivotal means (ii), and the bottom push arrangement composed of a flat, vertical element which extends into the large indentation of the rigid base;

(iv) elastic means attached between the top portion of the two legs of the support means below the pivotal mountings of the two side rods of the rod means, the tension of the elastic means urging the two support means back into alignment with the golf bag; and (v) a push rod holder attached to the bottom portion of the golf bag and through which the bottom of the two side rods of the push rod means are positioned so that the two side rods can slide freely therein.

The pressure on the bottom push arrangement of the push rod means causes the two legs of the support means to swing out of alignment with the golf bag to provide support for the golf bag when it is in a slanted or tilted position. The flat, vertical element of the bottom of the push rod arrangement contacts the top of the indentation in the rigid base as the golf bag is moved into the tilted position, thereby preventing the over extension of the stand legs when the bag is in the tilted position.

BRIEF DESCRIPTION OF THE DRAWINGS

In the drawings:

FIG. 4 is a top elevational view of the top hinged portion of the stand shown in FIG. 1;

FIG. 5 is a right elevational view of the top hinged portion of the stand shown in FIG. 4;

FIG. 6 is a back elevational view of the top hinged portion of the stand shown in FIG. 1;

DETAILED DESCRIPTION OF THE INVENTION

Figure 1:
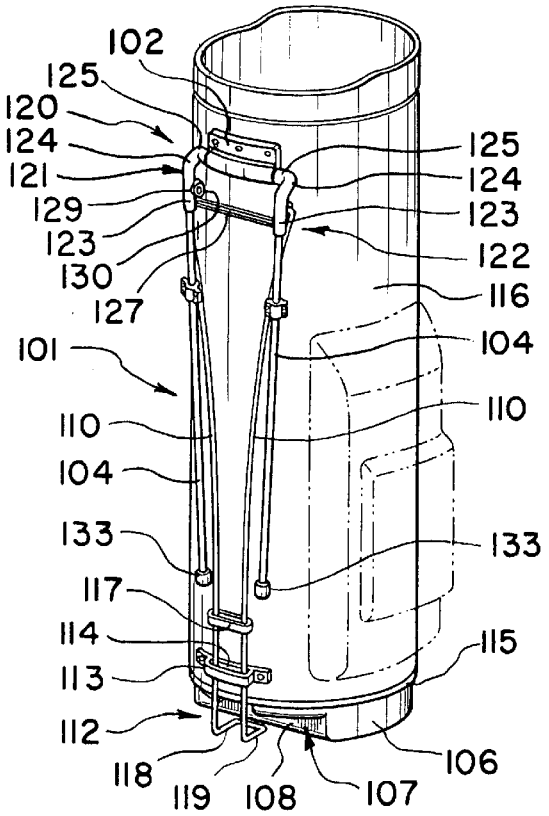
FIG. 1 is a back perspective view of a first embodiment of the golf bag with stand and indented base of the invention.
Figure 2:
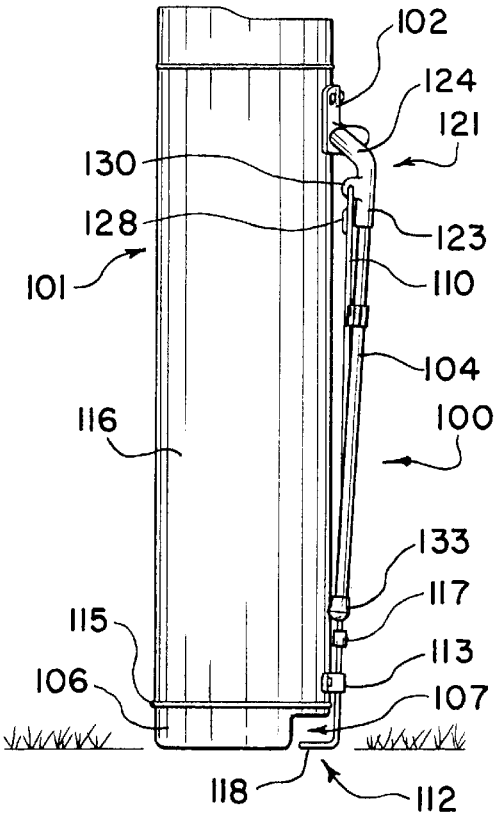
FIG. 2 is a right elevational view of the golf bag shown in FIG. 1.
Figure 3:
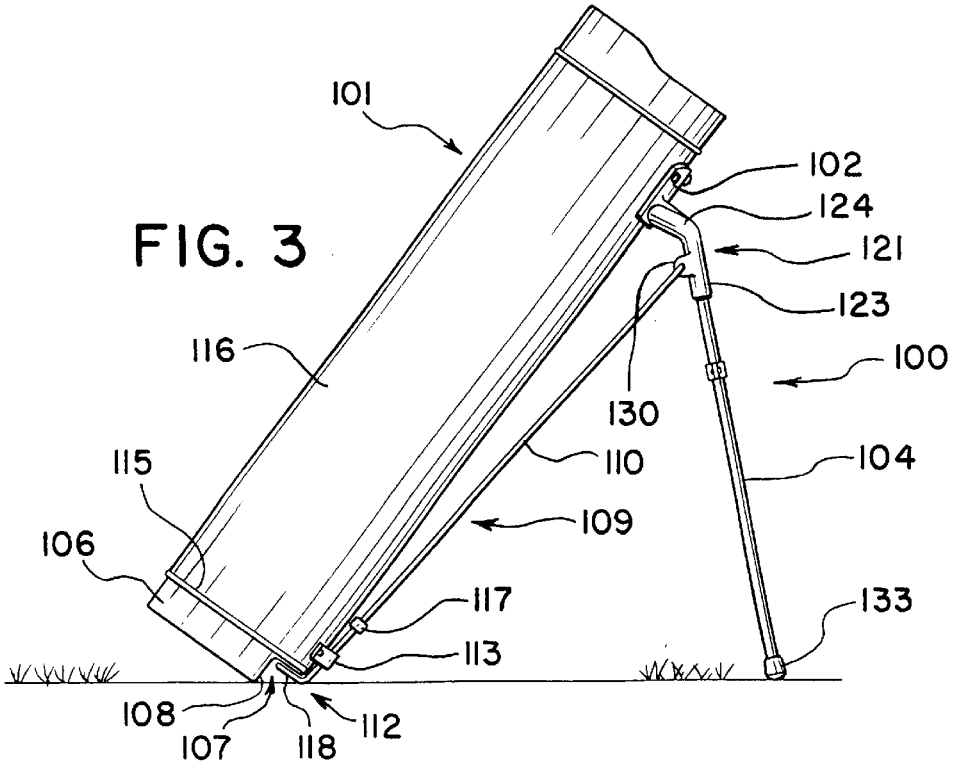
FIG. 3 is a right elevational view of the golf bag shown in FIG. 1 with the stand in an open and extended position.
Figure 8:
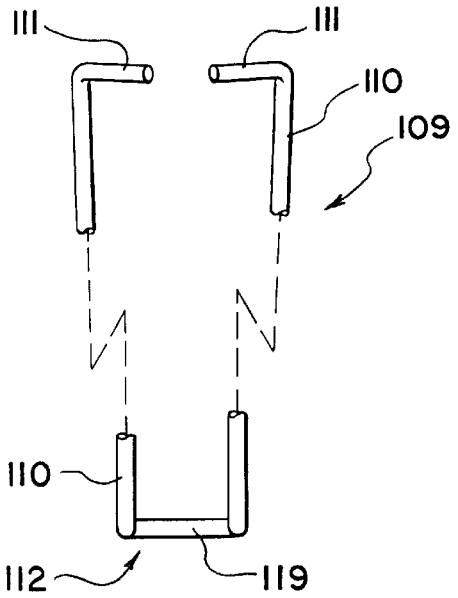
FIG. 8 is a back elevational view of the push rod of the stand shown in FIG. 1.
Figure 9:
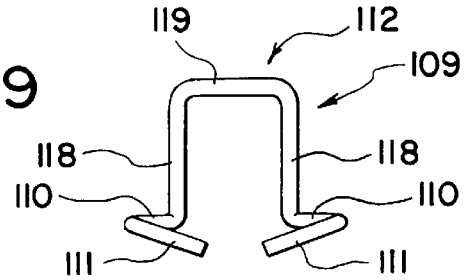
FIG. 9 is a top elevational view of the push rod of the stand shown in FIG. 1.
Figure 7:
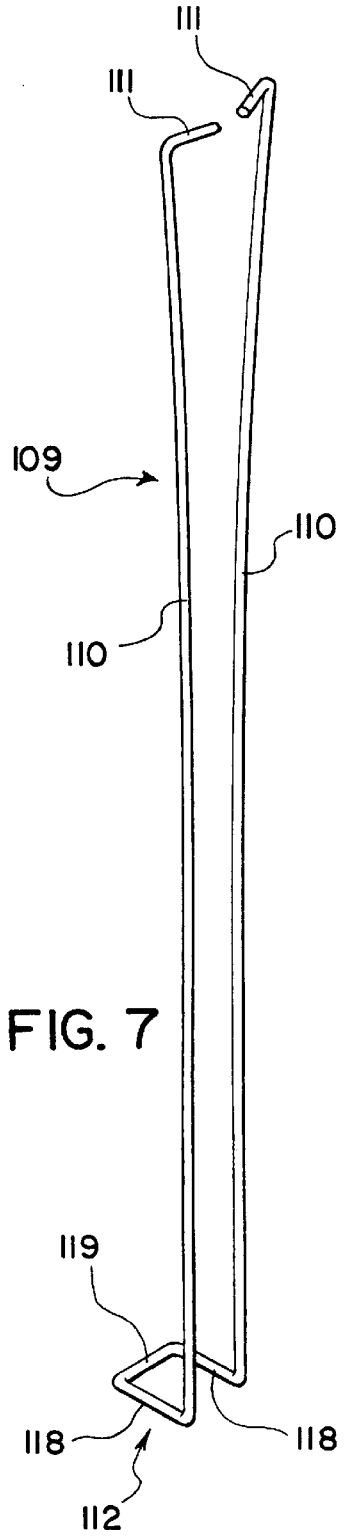
FIG. 7 is a back perspective view of the push rod of the stand shown in FIG. 1.
Figure 10:
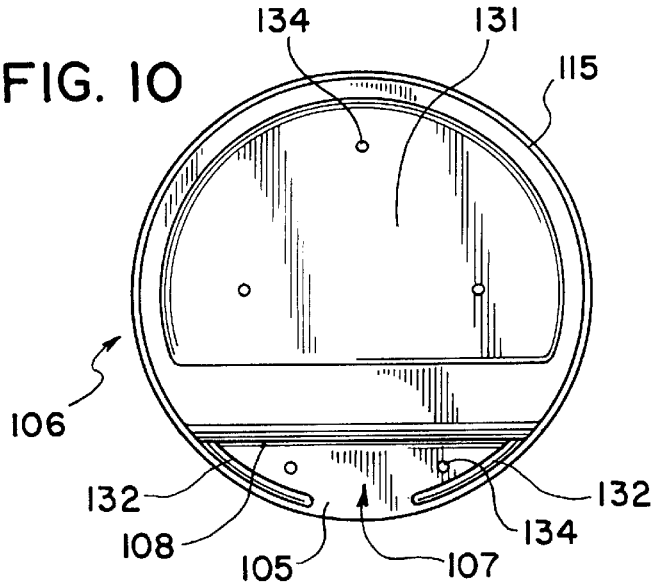
FIG. 10 is a bottom elevational view of the base of the golf bag shown in FIG. 1.

Generally, stand 100 will be attached to a golf bag 101. One embodiment of the invention is shown in FIGS. 1 to 10. Horizontal hinge 102 is attached to the top portion of golf bag 101. As best seen in FIGS. 4 and 6, horizontal holes 103 in hinge 102 have a slight outward and upward orientation to facilitate the expansion movement of vertical legs 104 of stand 100. The bottom of rigid base 106 of golf bag 101 has indented portion 107, which has top wall 105 and back wall 108. There are not any side wall extensions enclosing the side areas of indented portion 107 so as to avoid any interference with the tilting of golf bag 101. Push rod 109 has two vertical rods 110, two top cross bars 111 and bottom push rod extension 112. As shown best in FIGS. 1 and 7, vertical rods 110 are generally parallel but are slightly slanted outward in their top portion. Push rod tail holder 113 has center slot 114, through which vertical rods 110 fit in a freely slidable manner. The side wall of rigid base 106 above its rim 115 fits within the bottom of the tube portion 116 of golf bag 101. Push rod tail holder 113 is mounted on the bottom of golf bag 101 in the region of the side wall of rigid base 106. Clip 117 is mounted around vertical rods 110, near their bottom portion above holder 113, to hold vertical rods together so that they will freely slide through holder 113. Bottom push rod extension 112 has two horizontal push bars 118, each one connected to the bottom end of one of vertical rods 110. Horizontal push bars 118 extend into indentation 107 of rigid base 106. Horizontal bar 119 connects together the other ends of horizontal push bars 118. Adapters 120 are mounted on the top end of vertical legs 104. Adapter 120 consists of two mirror image units 121 and 122. Adapter 120 has lower vertical leg 123, which has a hole into which the end of vertical leg 104 fits. As shown in FIG. 5, the top of lower vertical leg 123 is curved (124) towards golf bag 101. Adapter 120 also has horizontal arm 125, which generally extends into the plane of the side of golf bag 101. Pin or bar 126 extends horizontally from the end of horizontal arm 125. Pin 126 pivotally fits in holes 103 of hinge 102. Horizontal arms 125 and pins 126 have a slight outward and upward orientation so as to readily fit in holes 103. Elastic band 127 fits over hooks 128 on the back of lower vertical legs 123 and help to hold pins 126 in holds 103. Elastic band 127 also resists the spread of vertical legs 104 when golf bag 101 is tilted, and then helps pull them back together to their original vertical, generally parallel orientation. Top cross bars 111 of vertical rods 110 are pivotally positioned in holes 129 in mountings 130 located on the back of lower vertical legs 123 above hooks 128. Push rod 109 is composed of a resilient metal (e.g., spring steel) so that the spring action thereof holds top cross bars 111 in holes 129, and so that vertical rods 110 bend outwardly when the bottoms of legs 103 pivot outwardly and away from each other when golf bag 101 is tilted (and vice versa). Recess 131 is located on the bottom of rigid base 106. The gap between rims 132 helps to keep bottom push rod extension 112 aligned when golf bag 101 is fully tilted. Nobs 133 are located on the bottom of vertical legs 104. Holes 134 in the bottom of rigid base 106 provide drainage.

In operation, the use of golf bag 101 tilts the top of golf bag 101. The tilting action pushes against bottom push rod extension 112, which in turn transmits the pressure up against pivot points 130 of the upper portions of vertical legs 104. (The bottom of vertical rods 110 rest against the ground when golf bag 101 is tilted). As a result, the bottom of vertical legs 104 move outwardly and away from each other so as to maintain a somewhat vertical orientation. The height of upper surface 105 of indentation 107 and the original orientation of bottom push rod extension 112 are such that, when extension 112 is stopped by upper surface 105, vertical legs 104 are extended slightly beyond the vertical so as to provide a tripod stability for tilted golf bag 101 (see FIG. 3). When golf bag 101 is raised back to the vertical, vertical legs 104, extension 112 and other parts return to their original positions and orientation.

Figure 11:
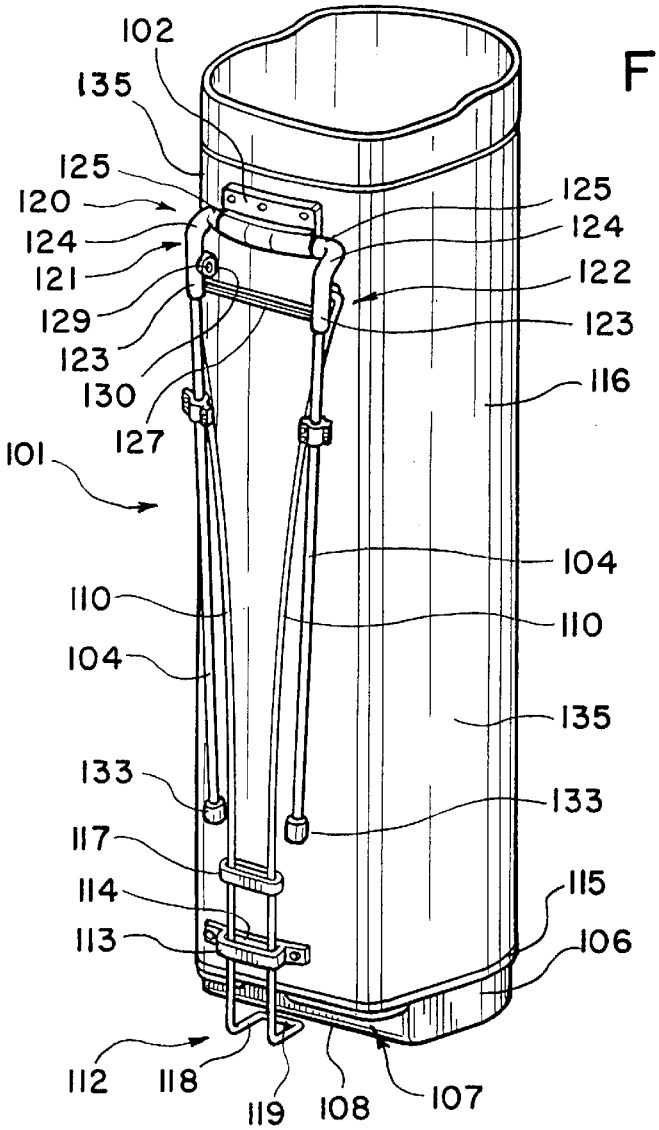
FIG. 11 is a back perspective view of a second embodiment of the golf bag with stand and indented base of the invention.
Figure 12:
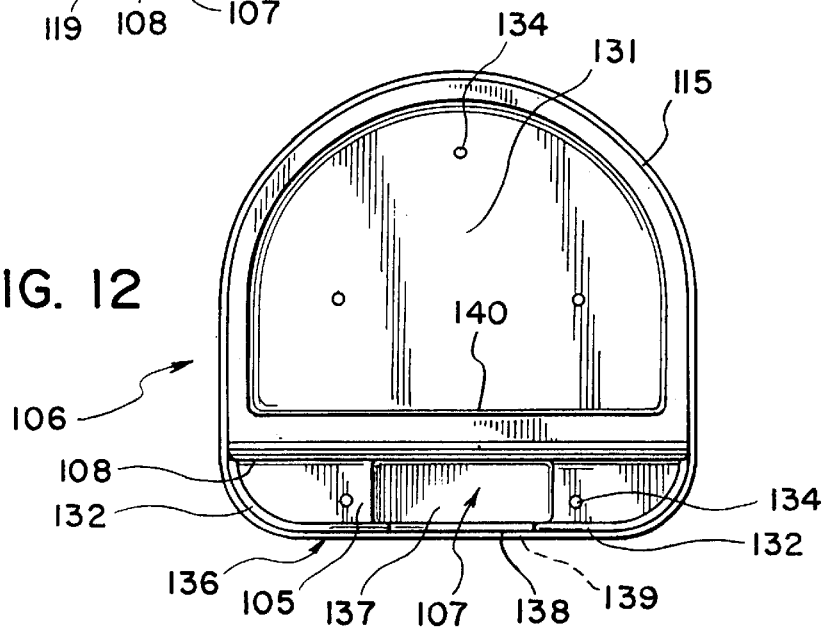
FIG. 12 is a bottom elevational view of the base of the golf bag shown in FIG. 11.

FIGS. 11 and 12 show a preferred embodiment of the invention. This embodiment is the same as or similar to the embodiment of FIGS. 1 to 10 except as noted below. The back side (135) of golf bag 101 is generally flat with only a slight convex curve in cross section. The back side (136) of rigid base 106 is flat. Upper surface 105 of indentation 107 contains recess 137 in the center thereof. Gap 138 between rims 132 is depressed so as to form a wall 139 along the outer side of recess 137. Recess 131 also has a flat back wall (140). The flat back wall arrangement of golf bag 101 provides more stability to the mounting of stand 100 and its actuation outward when golf bag 101 is tilted.

I claim:

1. A golf bag assemblage comprising:

(a) a golf bag having a top portion and a bottom portion;

(b) a rigid base, having a bottom and a side, mounted on the bottom of the golf bag, an indentation being located in the bottom of said rigid base, the indentation opening to the side and bottom of said base; and (c) a stand for the golf bag, the stand comprising:

(i) support means having two legs and a top cross segment, the top end of each of the two legs being a short, inwardly-facing cross bar which is pivotally attached to the top cross segment, and both of the legs extending downward, the top cross segment being affixed to the top portion of the golf bag, each of the two legs having a top portion below the top end thereof;

(ii) push rod means having two vertical resilient side rods, a bottom push arrangement to which the bottom of each of the two side rods is attached, and a short, inwardly-facing cross bar on the top end of each of the push rods, each of the short cross bars (ii) being pivotally mounted to one of the said legs below the pivotal attachments (i), and said bottom push arrangement composed of a flat element perpendicular to the longitudinal axis of the bag which extends at all times in a free floating manner into said indentation of said rigid base including when the golf bag is in the upright position with the bottom of the base in contact with a surface or above a surface and is in a slanted position, and which is unaffixed to any portion of said base, said two legs of the support means and said two side rods of the push rod means being aligned with the golf bag when the golf bag is in the upright position;

(iii) elastic means attached between the top portion of the two legs of the support means below the pivotal mountings of the two side rods of the rod means, the tension of the elastic means urging the two legs of the support means back into alignment with the golf bag; and (iv) a push rod holder attached to the bottom portion of the golf bag and through which the bottom of the two side rods of the push rod means are positioned so that said two side rods can slide freely therein, the pressure on the bottom push arrangement of the push rod means causing two legs of the support means to swing out of alignment with the golf bag to provide support for the golf bag when the golf bag is in a slanted position.

2. The golf bag assemblage of claim 1 wherein said flat element of said bottom push arrangement comprises short bars, each of which is connected on one end to bottom end of one of said push rods, and a cross bar, each end of which is attached to the other ends of said short bars.

* * * * *